US006413198B1

(12) United States Patent
Gray

(10) Patent No.: US 6,413,198 B1
(45) Date of Patent: Jul. 2, 2002

(54) MULTIPURPOSE EXERCISE AND STRETCHING APPARATUS

(76) Inventor: Gary W. Gray, 2701 Pfister Hwy., Adrian, MI (US) 49221

( * ) Notice: Subject to any disclaimer, the term of this patent is extended or adjusted under 35 U.S.C. 154(b) by 0 days.

(21) Appl. No.: 09/615,372

(22) Filed: Jul. 13, 2000

(51) Int. Cl.[7] ..... A63B 71/00

(52) U.S. Cl. ..... 482/148; 482/907; 482/35

(58) Field of Search ..... 482/148, 35–38, 482/907; 182/179.1, 141, 129, 152, 187, 20, 222; D25/162, 68; 248/235

(56) References Cited

U.S. PATENT DOCUMENTS

| | | | | |
|---|---|---|---|---|
| 1,019,037 A | | 3/1912 | Garland | |
| 1,142,137 A | | 6/1915 | Bathrick | |
| 2,648,539 A | * | 8/1953 | Packer | |
| D176,999 S | * | 3/1956 | Ahrens | |
| 2,817,522 A | * | 12/1957 | Margulies | |
| 3,120,955 A | | 2/1964 | Carlin | |
| 3,137,371 A | * | 6/1964 | Nye | |
| 3,601,397 A | * | 8/1971 | Carlin et al. | 482/36 |
| 3,737,161 A | | 6/1973 | Taylor et al. | |
| 4,340,217 A | * | 7/1982 | Gillis | 482/35 |
| 4,538,807 A | | 9/1985 | Rice | |
| 4,905,330 A | * | 3/1990 | Jacobs | 5/705 |
| 4,986,534 A | | 1/1991 | Meier et al. | |

* cited by examiner

*Primary Examiner*—Jerome W. Donnelly
*Assistant Examiner*—Lori Baker Amerson
(74) *Attorney, Agent, or Firm*—Emch, Schaffer, Schaub & Porcello Co., L.P.A.

(57) ABSTRACT

A multipurpose exercise and stretching apparatus includes a leverage system and a base platform. The leverage system includes a first component having a plurality of spaced apart horizontal bars; a second component having a foot support and at least one foot stirrup for supporting a foot; a third component having at least one lower grasping bar in a spaced apart relationship to the foot support component; a fourth component having a pair of opposed vertically extending angled grasping bars; a fifth component having a plurality of spaced apart horizontally extending overhead bars mounted on at least one overhead support member; and a sixth component having a plurality of spaced apart angled overhead bars. The first component is mounted on the base platform; the second component is operatively connected to and extends from a rear side of the first component; the third component is operatively connected to the rear side of the first component and is in a spaced apart relationship to the second component; the fourth component is operatively connected to the rear side of the first component and is in a spaced apart relationship to the third component; the fifth component is operatively connected to a top side of the first component; and, the sixth component is operatively connected to the rear side of the first component and extends between the fourth component and the fifth component.

38 Claims, 3 Drawing Sheets

MULTIPURPOSE EXERCISE AND STRETCHING APPARATUS

The present invention relates to exercise and stretching equipment and, in particular, to a multipurpose exercise and stretching apparatus which allows a participant, regardless of the exercise or stretching motion being performed, to always stretch in a preferred ergonomic and physiologically acceptable fashion.

BACKGROUND OF THE INVENTION

Flexibility and stretching have been found to be important in all areas of a person's life. It is important to stretch the body for improved performance in sports, occupations and other activities. Increasingly, it has been found that it is important for everyone to restore and maintain muscle and joint flexibility. Improved performance in all areas of life is accomplished by stretching the proper muscle groups, joints, and nerves in preparation for specific body movements and activities. While many people stretch instinctively to loosen up, rarely are the proper muscles stretched in the correct manner. Proper body positioning during stretching stimulates the circulatory flow and facilitates blood flow to the muscles, heart and brain to produce a relaxed, tension-free body. Proper body positioning during stretching also helps to decrease muscle soreness, joint aching, stress and headaches.

Proper stretching enhances stamina, power and coordination. Also, proper stretching encourages the healing of injured or under utilized muscle groups while decreasing the risk of injury and reducing continued trauma to the injured muscle.

Proper stretching of muscles, joints and nerves also enhances alertness and physical performance while decreasing the risk of injury whether in sports or work and especially those occupations which require lifting, standing, sitting and keyboard or assembly activities.

Further, when a person is participating in a sport or certain work activities it is desirable to perform warm-up exercises to help stretch the muscles which will be used in that sport or activity. In order to fully stretch those muscles, however, the participant must position his or her body in a particular manner in order to correctly stretch the muscles being used. Depending on the sport or activity, many muscle groups must be stretched and warmed-up in order to perform in a reasonable manner and without injury. Until the present invention, the participants had rely on their own knowledge of stretching in order to perform any warm-up exercises before attempting the activity. Thus, many participants simply stretched overhead or performed general reaching and bending motions in order to loosen up. However, the dynamics and mechanics involved in stretching muscles are particularly complex and involve the entire body.

In order to perform a reasonable stretching of the necessary muscles, the participant needs to stretch muscles using the greatest resistance. However, the participant usually stretches the muscles using the weakest resistance such that the necessary muscle groups have not been adequately stretched.

Further, various muscle groups need to be simultaneously stretched to prepare the participant's body for the desired activity. This is especially important since many activities involve muscles in the body which are not usually stretched in a proper manner.

Until the present invention, there has not been a multipurpose exercise and stretching apparatus which allows a participant to easily and efficiently perform the necessary stretching and warm-up steps in order to sufficiently carry out and perform a desired activity.

SUMMARY OF THE INVENTION

The present invention provides an improved multipurpose exercising and stretching apparatus. The stretching apparatus comprises a leverage system and a base platform. The leverage system comprises a plurality of stretching or exercise components. The present invention is especially useful for performing various types of stretching exercises in one location.

In a preferred embodiment, the components of the leverage system are adjacent each other so that the participant performs a first stretch by grasping certain designated components of the leverage system, then moves to a second stretch by grasping certain other designated components. A primary feature of the present invention is that the multipurpose stretching apparatus allows a participant to safely stretch muscles in a progressive manner without moving from one location. Each muscle group is warmed-up and stretched and, in turn, those stretched muscle groups are used to aid in stretching the subsequent muscle group. Each stretching exercise builds on the previous exercise so that all the muscles are stretched in a cumulative manner.

The multipurpose exercise and stretching apparatus described herein has a leverage system having multiple components that can be used in many different combinations. It should be understood that other embodiments can have different configurations of the components so that different combinations of stretches can be performed by the participant.

A first component of the leverage system comprises a plurality of spaced apart vertical bars having horizontal bars extending between the vertical bars.

A second component of the leverage system comprises a foot support having an angled support member, a heel or foot stirrup member which is positioned at an angle to a plane defined by the support member. The second component preferably extends from a back side of the first component.

A third component of the leverage system comprises at least one lower pair of vertically and horizontally extending grasping bars which are in a spaced apart relationship to the foot support component. The third component is preferably positioned above the second component and is preferably positioned adjacent the back side of the first component.

A fourth component of the leverage system comprises a pair of opposed angled gripping bars which angle in a downward direction. The fourth component is preferably positioned above the third component and is preferably positioned adjacent the back side of the first component.

A fifth component of the leverage system comprises a plurality of overhead horizontally extending bars mounted on a curved center support. The fifth component is preferably positioned over the first component.

A sixth component of the leverage system comprises a plurality of vertically angled overhead bars. The sixth component is preferably positioned above the fourth component and is preferably adjacent a top corner of the back side of the first component.

The multipurpose stretching apparatus, in preferred embodiments, further includes a support platform to keep the participant's feet at a preferred angle. The support platform includes a first angled mat which angles upwardly from a midline and a second angled mat which angles upwardly in an opposite direction from the first angled mat. The support platform is positioned beneath the first component and is generally perpendicular to the first component such that the participant stands on the support platform to use each component of the multipurpose stretching apparatus.

The multipurpose exercise apparatus of the present invention can be used for many types of stretches and exercises. It should be understood that many types of activities other than sports also involve the use of multiple muscle groups and that a participant can use the apparatus of the present invention to perform such stretching exercises.

The present invention thus provides a biomechanically correct and ergonomically sound stretching apparatus that allows the participant to safely exercise and stretch each group of muscles in a logical and cumulative fashion.

The stretching apparatus of the present invention allows the participant to perform many stretching exercises to sufficiently stretch and warm-up every part of the body needed to perform a desired activity. The stretching apparatus also allows the participant to isolate and focus on stretching different muscle groups.

The stretching apparatus of the present invention allows the participant to perform all of the various stretching exercises in one centralized location. The stretching apparatus is compact and requires comparatively few pieces of equipment.

The stretching apparatus uses the participant's body's natural upright position and provides for proper body alignment, safety, and stability. The stretching apparatus properly positions the body relative to gravity, and the stretches are easy to understand and follow, with a logical progression and complementary combinations.

The stretching apparatus allows the participant to perform multiple stretching exercises without spending time resetting the apparatus in order to perform certain stretches or exercises. The participant can perform the stretching exercises without the need to handle weights or to make adjustments for his or her own particular height and/or flexibility.

The stretching apparatus of the present invention provides physical and mental benefits including: improving alertness and physical performance; enhancing stamina, power and coordination; encouraging of healing of injured or underutilized muscle groups; decreasing muscle soreness, joint aching, stress and headaches; decreasing risk of injury; reducing accumulative trauma; and, producing a relaxed tension-free body.

The stretching apparatus is especially useful in industrial environments where use of the stretching apparatus can increase productivity and morale, decrease injuries and employer related costs due to those injuries. Use of the stretching apparatus increases work efficiency by properly preparing the body for all job-related functions such as lifting, standing, sitting, and keyboard or similar activities. The stretching apparatus is a compact environment which, when used, simply and safely prevents work-related musculo-skeletal injuries. Further, use of the stretching apparatus in work environments consistently enhances individual morale, alertness, and physical performance while providing each employee a convenient and safe place to stretch and feel better. The stretching apparatus provides a biomechanically designed environment which is the most-effective system to satisfy prevention, ergonomic, and rehabilitation needs of industry.

The stretching apparatus of the present invention is also specially useful in applications for athletes and in health clubs. The stretching apparatus is innovative in function, yet simple and safe. The functionally designed leverage system of the present invention allows for hundreds of proper stretches for any sport or activity. The stretching apparatus provides the most effective environment for warm-up and cool-down for all forms of exercise, or provides a complete workout by itself. The stretching apparatus serves as a quick, simple and safe system to enhance overall stamina, power, and coordination. Use of the stretching apparatus allows the participant to have individualized program which decreases the chance of injury and dramatically enhances performance and the feeling of well being.

The stretching apparatus of the present invention is also a useful applications in the rehabilitation field. The stretching apparatus allows a health practitioner to prescribe hundreds of patient-specific stretching exercises which can be performed in a functionally correct, upright, and safe environment. The biomechanically designed stretching apparatus facilitates both functionally correct tissue lengthening and join mobilization through four-point, tri-plane stretching. Use of the stretching apparatus enhances stretching, strengthening, and manual therapeutic techniques to effectively decrease pain and immediately improve a patient's body's function. The stretching apparatus provides a system to enhance proprioception and balance while documenting consistent functional progress in the patient.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 1:
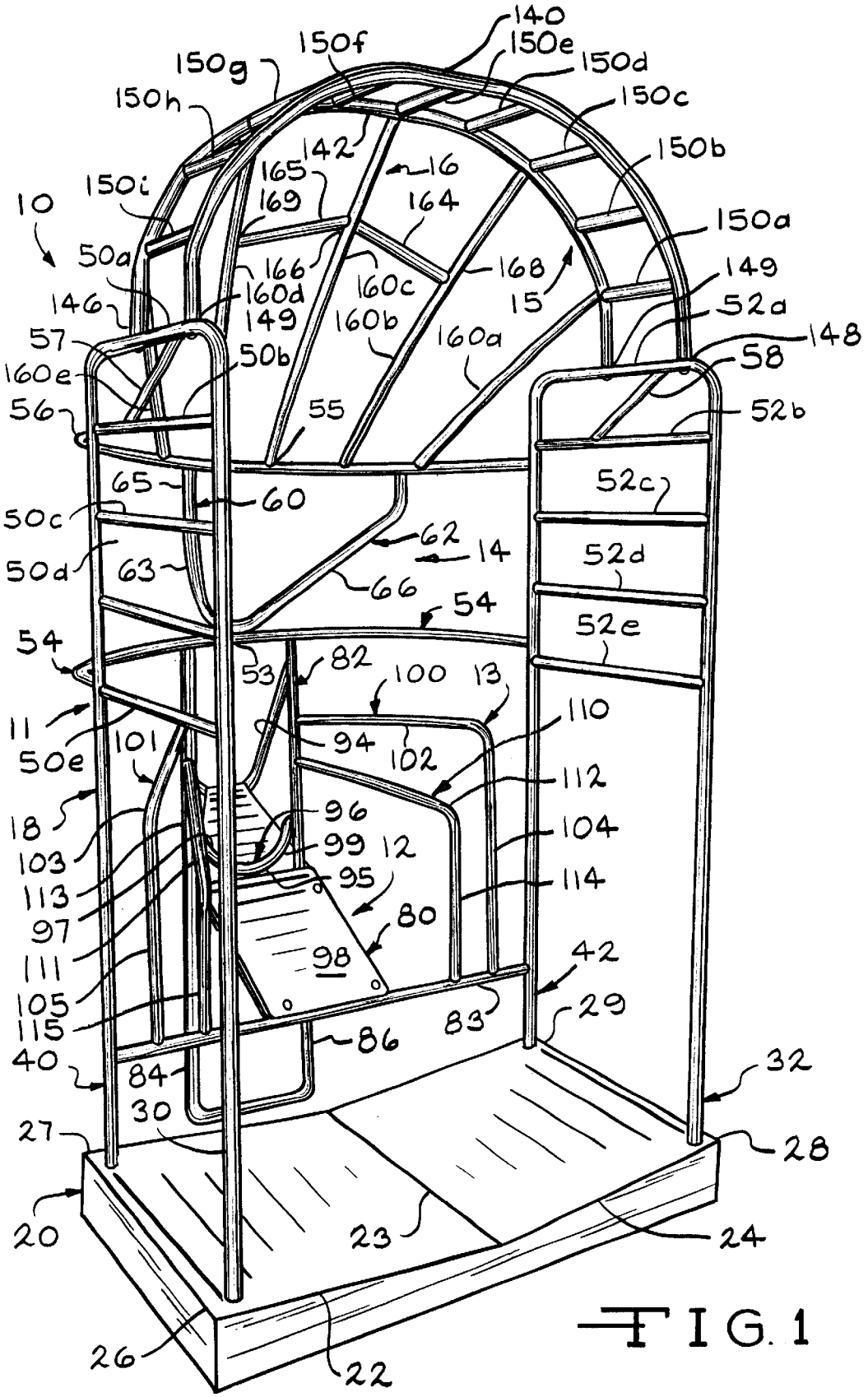
FIG. 1 is a perspective view of a stretching apparatus.
Figure 2:
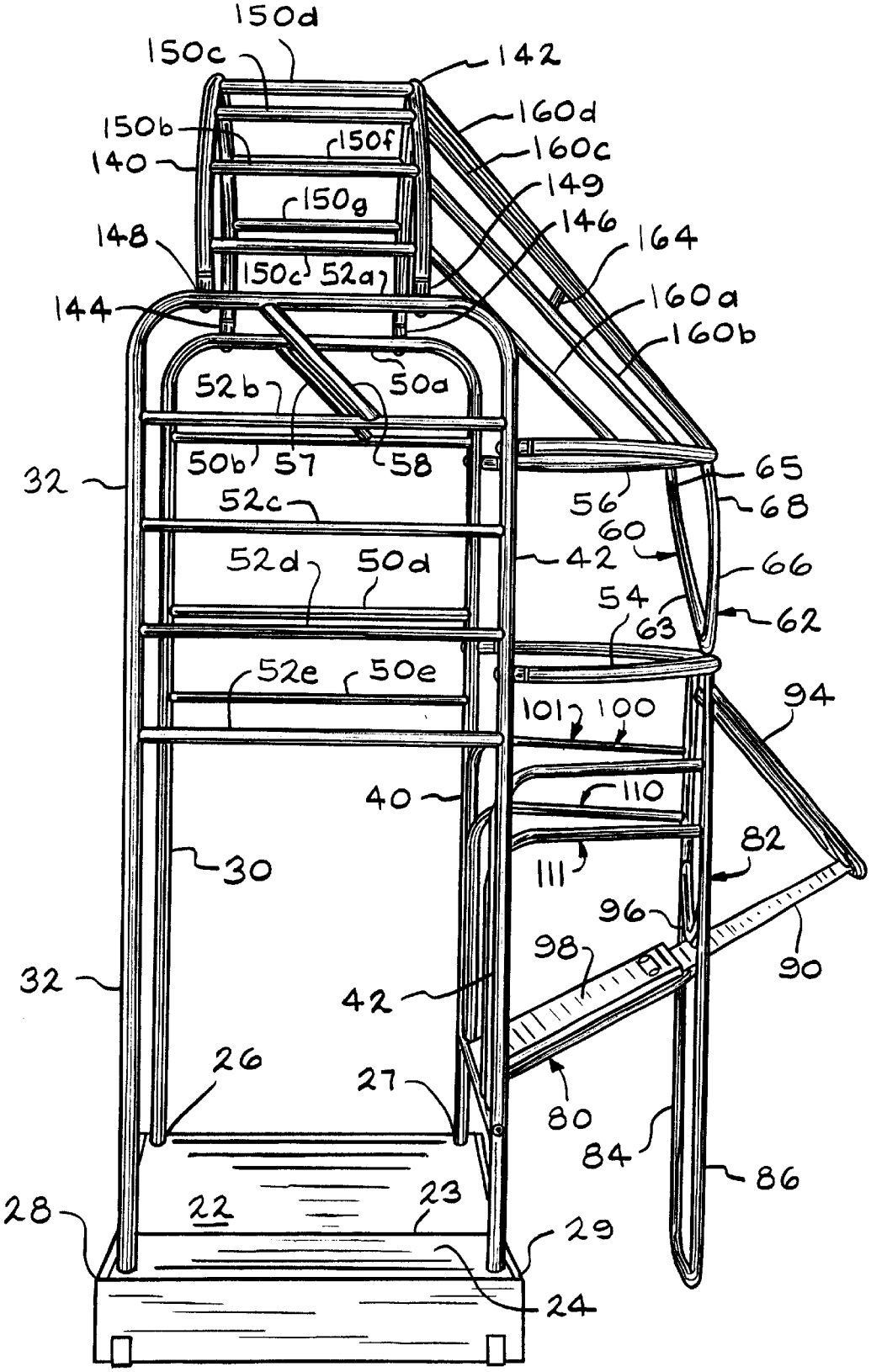
FIG. 2 is a side elevation perspective view of the stretching apparatus.
Figure 3:
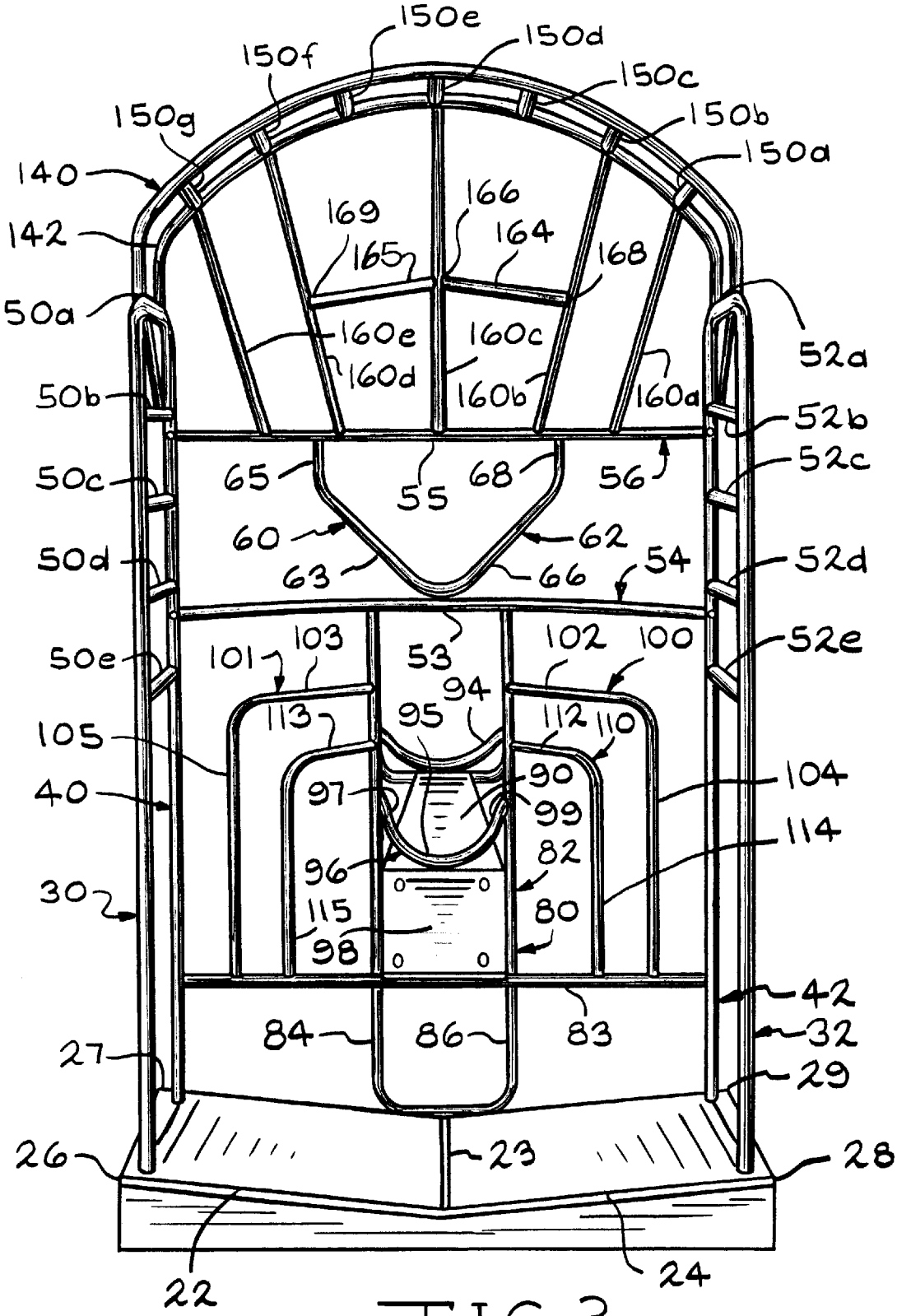
FIG. 3 is a front elevation perspective view of the stretching apparatus.

FIG. 1 is a perspective view of a multipurpose stretching apparatus 10 comprising a leverage system 18 and a base platform 20. The leverage system 18 comprises multiple components that can be used in many different combinations. In the embodiment shown, the leverage system 18 of the stretching apparatus 10 comprises a first component 11 for generally stretching to the side, a second component 12 for generally stretching the foot and leg, a third component 13 for generally stretching in a lower or downward direction, a fourth component 14 for generally stretching in an outward midlevel direction, a fifth component 15 for generally stretching in directly overhead direction, and a sixth component 16 for generally stretching in an angled overhead direction. Each component of the leverage system will be described in detail in a preferred sequence for completing certain stretching exercises. However, it should be understood that the stretching exercises can be completed in any order by the participant. Further, each stretching exercise will be described in connection with the mechanics and physiology involved in performing the desired stretching exercise.

Preferred embodiments of the stretching apparatus 10 include the support platform 20 which can be placed at a comfortable angle, as best shown in FIG. 1, to position and support the participant. The support platform 20 includes a first angled mat 22 and a second angled mat 24 which are positioned at an angle from about 4° to about 8° with respect to the floor or support surface upon which the stretching apparatus 10 is positioned, and most preferably at about a 6° angle, from a midline 23. The first and second angled mats 22 and 24 slope upwardly from the midline 23 of the support platform 20. In practice it has been found that positioning the first and second angled mats 22 and 24 at an angle of about 6° is preferable. When the participant stands on the platform, the participant's feet are positioned at an angle as the participant's body is turned or rotated and stretched. The angled position of the feet allows the body to stretch more effectively. As each foot stays at the desired angle, rotation of the participant's body allows the muscles in the legs and torso to more fully stretch.

The first component 11 of the stretching apparatus 10 is shown as being constructed of a suitable tubular material and is mounted on the base platform 20.

The first component 11 of the stretching apparatus 10 includes front first and second opposed generally vertically extending support members 30 and 32, respectively, which extend from the platform 20 at front platform corners 26 and 28, respectively, of the platform 20. Rear first and second opposed generally vertically extending support members 40 and 42, respectively, extend from opposing rear platform corners 27 and 29, respectively. The support members 30 and 32, 40 and 42, extend generally at a perpendicular direction from the platform 20 and are parallel to each other.

The first front vertically extending support member 30 is connected to the first rear vertically extending support member 40 by a plurality of generally horizontally extending bars 50*a*, 50*b*, 50*c*, 50*d* and 50*e*. Similarly, the second front vertically extending support member 32 is connected to the second rear vertically extending support member 42 by a plurality of spaced apart horizontal bars 52*a*, 52*b*, 52*c*, 52*d* and 52*e*. It is to be understood that either fewer or more horizontally extending bars can be positioned between the first support members and the second support members and that such other numbers of horizontally extending bars are within the contemplated scope of the present invention.

A first curved horizontally extending grasping bar 54 extends in a rearward direction away from the first and second rear support members 40 and 42. A second curved horizontally extending grasping bar 56 also extends in a rearward direction away from the first and second rear support members 40 and 42. Each grasping bar 54 and 56 defines an opposed curved distal portion 53 and 55, respectively.

In the embodiment shown, at least one angled side bar 57 extends between the horizontal side bar 50*a* and the adjacent horizontal side bar 50*b*. Similarly, a second angled side bar 58 extends between the horizontal side bar 52*a* and the adjacent horizontal side bar 52*b*. While not shown, it should be understood that other angled bars (not shown) can extend between other adjacent horizontal side bars, such as between bars 50*b*–50*c*, between bars 50*c*–50*d* and/or between bars 50*d*–50*e*; and between bars 52*b*–52*c*, between bars 52*c*–52*d*, and/or between bars 52*d*–52*e*. In the embodiment shown, the angled side bar 57 extends in a downward direction from the front support member 30 toward the rear support member 40. Similarly, the angled side bar 58 extends in a downward direction from the front support member 32 toward the rear support member 42.

The horizontal grasping bars 50*a*–*e*, 52*a*–*e*, the curved horizontal grasping bars 54 and 56, and the angled side bars 57 and 58 are designed to be grasped by the participant to stretch various muscles by longitudinally extending these muscles. In one stretching regime, the participant faces the curved horizontal grasping bars 54 and 56 and takes a step forward on one of the angled mats 22, 24 to position one foot closer to the horizontal bars 54 and 56. The other foot remains positioned on the other angled mat. The participant leans forward and grasps the first horizontal bar 54 keeping his heels down on the angled mats 22 and 24. The angled floor mats 22 and 24 keep the feet positioned at the desired angle so that the desired foot position is maintained during the stretch. As the muscles are stretched, the participant can reach for the higher horizontal bar 56 to further elongate or stretch the muscles. This stretching is done in rotation for both feet and legs on the right and left sides. Afterwards, the participant places his feet in a stationary position keeping his heels on the ground and his knees over his feet for balance. The participant reaches to one side to grasp the horizontal grasping bars 50*a*–*e* and/or 52*a*–*e*, the angled bars 57 and 58, or the vertical bars 30, 32 and 40, 42 such that muscles are stretched when the body is in a turned position. While the participant is leaning forward, both calves are continuing to be stretched. As the body is rotated to one side and then the opposite side, the muscles of the legs, hip and torso are elongated and stretched.

The second component 12 of the stretching apparatus 10 includes a foot support 80 operatively connected to the first horizontal grasping bar 54 by a foot support frame member 82. The foot support frame member 82 extends in a perpendicular direction toward the floor from the horizontal grasping bar 54. In a preferred embodiment, the foot support frame member 82 comprises parallel and spaced apart first and second support bars 84 and 86. A horizontal cross foot support member 83 which extends between the first and second rear vertical support members 40 and 42.

The foot support 80 extends from the horizontal foot support member 83 through the bars 84 and 86. In a preferred embodiment of the invention, the angled foot support 80 is positioned at about a 45° angle with respect to a plane defined by the horizontal cross foot support bar 83. However, it is also within the contemplated scope of the present invention that the foot support 80 can be positioned at other optimum angles if desired.

In the embodiment shown a foot rest 90 extends from the foot support 80. The plane defined by the foot rest 90 is substantially parallel to the plane defined by the foot support 80. However, it should be understood that according to the present invention, the foot rest 90 can be positioned at an angle to the foot support 80 or the foot rest 90 can be eliminated from the stretching apparatus 10.

The foot rest 90 extends beyond the vertical foot support member 82 and is operatively connected to the vertical support member 82 by an angled foot member 94.

The foot support 80 further includes a generally V-shaped foot stirrup 96 which extends between the first and second frame members 84 and 86 at a point adjacent the angled foot rest 90. The foot stirrup 96 includes a heel support 95 and curved support bars 97 and 99 which extend upwardly at an acute angle in an opposing direction from the heel support 95. The angled support bars 97 and 99 form a generally V or triangular shape. In a preferred embodiment, a non-skid durable resilient or rubber-type mat 98 is positioned on the foot support 80 and/or the foot rest 90 so that the foot remains steady and does not slip or turn.

Optimum stretching occurs when the participant is standing on the support platform 20. The participant places a foot on the foot support 80 or foot rest 90 to initiate a stretch of the leg muscles including the calf, thigh and hip flexor muscles. The hip flexor muscles are important to stretch since they connect the torso to the leg and are generally the major muscles used in forward propulsion in walking.

In certain stretching regimes, when the participant has his heel positioned in the foot stirrup 96, the participant can stretch the calf muscles, the hip flexor muscles and hamstring muscles which provide the power source to a rotational movement of the body. A hamstring muscle include three sets of muscles, two of which are attached to the inner portion of the leg, and one of which attaches to the outer portion of the leg. The participant stands on an angled portions 22 and 24 of the mat, which aid in keeping the calf stretched and in a proper everted position. The participant places one foot on the heel support 95 while grasping a suitable grasping bar and leans forward. This motion stretches the calf muscles, the hip flexors, and the hamstrings. In order to achieve full stretching of the hamstring, the participant rotates the foot toward the first angled support 97 and stretches. The participant then rotates the foot the opposing angled support 99 and stretches. If the right foot is positioned on the heel support 95, the toe portion of the foot is rotated in a direction toward the first angled support 97 which stretches the outer hamstring. The participant is instructed to then rotate his foot to the opposing second angled portion 99, which stretches the inside hamstring muscles. In certain stretching regimes, the participant first performs a stretching while having his chest facing the foot stirrup 96. The participant then performs a stretch in the side direction and stretches while having a shoulder facing the first foot stirrup 96 and finally stretches in yet another direction while having his back facing the foot stirrup 96.

The third component 13 of the stretching apparatus 10 includes at least a first pair of lower grasping bars 100 and 101 which extend from the vertical foot support members 84 and 86, respectively, in opposing directions. The lower grasping bars 100, 101 each have a first section 102 and 103, respectively, which extend in a generally horizontal forward direction toward the rear support members 40 and 42, respectively. Each lower grasping bars 100 and 101 generally has a curves at an angle such that second sections 104 and 105 of the bars 100 and 101, respectively, are in a spaced apart and parallel relationship to the rear vertical support members 40 and 42. The vertical sections 104 and 105 terminate at the horizontal cross foot support bar 83.

The third component can include a second pair of horizontal extending grasping bars, 110 and 111 which extend from the vertical support members 84 and 86, respectively, in opposing directions. The lower horizontal grasping bar 110 and 111 each have a first section 112 and 113, respectively, which extend in a generally horizontal direction toward the rear support members 40 and 42, respectively. In the embodiment shown, the first sections 112 and 113 are in a spaced apart and parallel relationship to the first sections 102 and 103 of the first lower grasping bars 100 and 101, respectively. Each lower grasping bars 110 and 111 generally have a curves at an angle such that second sections 114 and 115 of the bars 110 and 111, respectively, are generally in a spaced apart and parallel relationship to the rear support members 42 and 44. In the embodiment shown, the second sections 114 and 115 are also in a spaced apart and parallel relationship to the members 104 and 105 of the horizontal grasping bars 100 and 101. The vertical sections 114 and 115 terminate at the horizontal cross foot support bar 83. The lower grasping bars 100, 101, 110, and 111 can be used to accommodate smaller individuals or to vary the intensity and range of a stretching motion.

The exercises described above generally provide stretching to the lower body and can be used for many different types of sports and other physical activities. It is also to be understood, however, that other exercises can be performed using these portions of the stretching apparatus. For example, the participant can place his body at a right angle to the second and third components 12 and 13, respectively. The participant has his shoulder facing the stirrup 96 by placing his foot in the heel support 95 and then rotates the foot to the angled supports 97, 99 to stretch groin muscles.

The fourth component 14 of the stretching apparatus 10 includes a pair of opposed angled grasping bars 60 and 62 which extend from the first curved horizontal grasping bar 54 to the second horizontal grasping bar 56. In the embodiment shown, the angled grasping bar 60 includes a first angled portion 63 and a vertically extending portion 65 which is operatively connected to and is generally perpendicular to the second grasping bar 56. In the embodiment shown, the opposing angled grasping bar 62 has a generally complimentary or mirror shape to the first grasping bar 60. The second grasping bar 62 has a first angled portion section 66 and a vertically extending portion 68 which is operatively connected to and terminates at the second curved grasping bar 56. The participant grasps the opposed angled grasping bars 60 and 62 to perform further stretching exercises.

The fifth component 15 of the stretching apparatus 10 includes at least one, and preferably a pair of, arcuate or radially curved overhead support members 140 and 142. Each overhead arcuate support member 140 and 142 has first ends 144 and 146, respectively, which extend from the upper most side bar 50*a* and terminate at second ends, 148 and 149, at the upper most side bar 52*a*. A plurality of parallel horizontally extending overhead cross bars 150*a–i* extend from the first overhead member 140 to the second overhead member 142. It is to be understood that the present invention can comprise different numbers of horizontal overhead cross grasping bars 150. In certain stretching regimes, the participant stands on the platform 20 and grasps any one of the horizontal overhead bars 150*a–i* with one hand while grasping another section of the stretching apparatus with the other hand. As the participant works his way from one horizontal overhead bar 150*a* to an adjacent bar 150*b*, the participant stretches the upper body muscles. The participant can also take his right hand and grasp opposing bars so that his arm is crossed over his body. This exercise can be repeated for the opposing side. Also, it should be understood that during the stretching of the pelvis and torso, the side grasping bars 50*a–e* and 52*a–e* can be used to further stretch the back and torso and chest muscles. By keeping one hand steady on a side grasping bar 50*a–e* or 52*a–e*, the participant is able to open up and stretch his back and neck muscles. As the participant stretches, he is able to take advantage of the stretching of the lower body, calf, hip flexor and hamstrings. The participant repeats the same stretches by reversing hands. The participant sequentially reaches above his head to the overhead grasping bars 150 while the opposing hand is crossed over his body such that the body is rotated in a pivoting manner. This stretching exercise is then repeated using opposing hands. This stretching provides a dual level stretch by allowing the lower rotation of the body at one angle while providing an upper rotation of the body at another angle. The lower stretching provides pelvis and lower back stretching while the hand is extended above the head provide upper back and neck stretching. When the participant stretches using these different bars as fulcrums, the participant is able to achieve optimum stretching rather than just having his body stretched in a path of less resistance.

The sixth component of the stretching apparatus 10 includes a plurality of parallel and spaced apart angled overhead grasping bars 160*a–e* which extend at an angle from the second overhead grasping member 142 to the second horizontal grasping bar 56. A pair of opposed angled crossbars 164 and 165 extend in opposing directions from a midportion 166 of the generally centrally located angled bar 162*c* and terminate at midportion 168 and 169 of the adjacent angled bars 162*b* and 162*d*, respectively. It is to be understood that other angled cross bars (not shown) can extend between adjacent angled overhead grasping bars 160*a–e*, and that such bars are within the contemplated scope of the present invention.

In certain preferred embodiments, the angled overhead bars 160*a–e* slope at a downward angle which is preferably at about 45° from a horizontal plane defined by the second horizontal grasping bar 56. In certain stretching regimes, the participant stands on the platform 20 and grasps one or more of the angled overhead bars 160*a–e* with one hand while grasping either at least one of the side grasping bars 50*a*–e or 52*a–e*, or the front vertical grasping bars 30, 32 or rear vertical bars 40 and 42 and performs a desired stretch.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limited sense, the scope of the invention being defined solely by the appended claims.

I claim:

1. A multipurpose exercise and stretching apparatus comprising a four point, tri-plane stretching leverage system and a base platform, the leverage system including a base platform comprising a first angled mat which angles upwardly from a midline and a second angled mat which angles upwardly in an opposite direction from the first angled mat;

a first component having a plurality of spaced apart horizontal bars;

a second component having a foot support and at least one foot stirrup for supporting a foot;

a third component having at least one lower grasping bar in a spaced apart relationship to the foot support component;

a fourth component having a pair of opposed vertically extending angled grasping bars;

a fifth component having a plurality of spaced apart horizontally extending overhead bars mounted on at least one overhead support member; and, a sixth component having a plurality of spaced apart angled overhead bars, wherein the first component is mounted on the base platform; the second component is operatively connected to and extends from a rear side of the first component; the third component is operatively connected to the rear side of the first component and is in a spaced apart relationship to the second component; the fourth component is operatively connected to the rear side of the first component and is in a spaced apart relationship to the third component; the fifth component is operatively connected to a top side of the first component; and, the sixth component is operatively connected to the rear side of the first component and extends between the fourth component and the fifth component.

2. The apparatus of claim 1, wherein the first component comprises a first set of the horizontal bars mounted on at least one pair of vertically extending grasping bars and a second set of the horizontal bars mounted on an opposing pair of vertically extending grasping bars.

3. The apparatus of claim 1, wherein the first component includes at least one angled bar extending between adjacent horizontal bars.

4. The apparatus of claim 1, wherein the foot support of the second component includes an angled support member.

5. The apparatus of claim 1, wherein the foot stirrup of the second component includes opposed angled support bars which form a generally V- or triangular shape.

6. The apparatus of claim 1, wherein the third component includes at least one pair of opposed lower grasping bars, the lower grasping bars having first sections extending horizontally at an angle from the foot support and second sections extending vertically at an angle from the first sections.

7. The apparatus of claim 1, wherein the fourth component comprises generally V-shaped vertically extending angled grasping bars.

8. The apparatus of claim 1, wherein the fifth component includes first and second spaced apart and parallel curved overhead members, the horizontal overhead bars extending between the first and second curved overhead members.

9. The apparatus of claim 1, wherein the sixth component includes at least one angled cross bar which extends between adjacent angled overhead bars;

wherein the first component is mounted on the base platform; the second component is operatively connected to and extends from a rear side of the first component; the third component is operatively connected to the rear side of the first component and is in a spaced apart relationship to the second component; the fourth component is operatively connected to the rear side of the first component and is in a spaced apart relationship to the third component; the fifth component is operatively connected to a top side of the first component; and, the sixth component is operatively connected to the rear side of the first component and extends between the fourth component and the fifth component.

10. The apparatus of claim 1, wherein the base platform includes a first angled mat 22 and a second angled mat 24 which are positioned at an angle from about 4° to about 8° with respect to a floor or support surface upon which the stretching apparatus 10 is positioned.

11. The apparatus of claim 10, wherein the mats are positioned at about a 6° angle, from a midline.

12. The apparatus of claim 1, wherein the first component of the stretching apparatus includes front first and second opposed generally vertically extending support members 30 and 32, respectively, which extend from the platform 20 at front platform corners 26 and 28, respectively, of the platform 20; and rear first and second opposed generally vertically extending support members 40 and 42, respectively, extending from opposing rear platform corners 27 and 29, respectively, wherein the support members 30 and 32, 40 and 42, extend generally at a perpendicular direction from the platform 20, are parallel to each other, and are connected to the spaced apart horizontal bars.

13. The apparatus of claim 12, wherein the first front vertically extending support member 30 is connected to the first rear vertically extending support member 40 by a plurality of generally horizontally extending bars 50*a*, 50*b*, 50*c*, 50*d* and 50*e*; and the second front vertically extending support member 32 is connected to the second rear vertically extending support member 42 by a plurality of spaced apart horizontal bars 52*a*, 52*b*, 52*c*, 52*d* and 52*e*.

14. The apparatus of claim 13, wherein a first curved horizontally extending grasping bar 54 extends in a rearward direction away from the first and second rear support members 40 and 42, and a second curved horizontally extending grasping bar 56 also extends in a rearward direction away from the first and second rear support members 40 and 42, wherein each grasping bar 54 and 56 defines an opposed curved distal portion 53 and 55, respectively.

15. The apparatus of claim 14 wherein at least one angled side bar 57 extends between the horizontal side bar 50*a* and the adjacent horizontal side bar 50*b*, and a second angled side bar 58 extends between the horizontal side bar 52*a* and the adjacent horizontal side bar 52*b*.

16. The apparatus of claim 14, wherein the second component of the stretching apparatus includes the foot support 80 operatively connected to the first horizontal grasping bar 54 by a foot support frame member 82, wherein the foot support frame member 82 extends in a perpendicular direction toward the floor from the horizontal grasping bar 54.

17. The apparatus of claim 16, wherein the foot support frame member 82 comprises parallel and spaced apart first and second support bars 84 and 86 and a horizontal cross foot support member 83 which extends between the first and second rear vertical support members 40 and 42.

18. The apparatus of claim 17, wherein the foot support 80 extends from the horizontal foot support member 83 through the bars 84 and 86.

19. The apparatus of claim 18, wherein the foot support 80 is positioned at about a 45° angle with respect to a plane defined by the horizontal cross foot support bar 83.

20. The apparatus of claim 19, wherein a foot rest 90 extends from the foot support 80, wherein a plane defined by the foot rest 90 is substantially parallel to a plane defined by the foot support 80.

21. The apparatus of claim 20, wherein a foot rest 90 is positioned at an angle with respect to the foot support 80.

22. The apparatus of claim 20, wherein a non-skid durable resilient mat 98 is positioned on at least one of the foot support 80 or the foot rest 90.

23. The apparatus of claim 21, wherein the foot rest 90 extends beyond the vertical foot support member 82 and is operatively connected to the vertical support member 82 by an angled foot member 94.

24. The apparatus of claim 21, wherein the foot stirrup 96 extends between the first and second frame members 84 and 86 at a point adjacent the angled foot rest 90, wherein the foot stirrup 96 includes a heel support 95 and curved support bars 97 and 99 which extend upwardly at an acute angle in an opposing direction from the heel support 95.

25. The apparatus of claim 27, wherein the angled support bars 97 and 99 form a generally V or triangular shape.

26. The apparatus of claim 15, wherein at least one angled bar extends between at least one other adjacent horizontal side bars, the at least one angled bar extending between bars 50*b*–50*c*, between bars 50*c*–50*d* or between bars 50*d*–50*e*; and between bars 52*b*–52*c*, between bars 52*c*–52*d*, or between bars 52*d*–52*e*.

27. The apparatus of claim 15, wherein the angled side bar 57 extends in a downward direction from the front support member 30 toward the rear support member 40, and the angled side bar 58 extends in a downward direction from the front support member 32 toward the rear support member 42.

28. The apparatus of claim 1, wherein the third component of the stretching apparatus includes at least a first pair of lower grasping bars 100 and 101 which extend from vertical foot support members 84 and 86, respectively, in opposing directions; the lower grasping bars 100, 101 each having first sections 102 and 103, respectively, which extend in a generally horizontal forward direction toward rear support members 40 and 42, respectively; each lower grasping bars 100 and 101 having a curve at an angle such that second sections 104 and 105 of the bars 100 and 101, respectively, are in a spaced apart and parallel relationship to the rear vertical support members 40 and 42; and, where the vertical sections 104 and 105 terminate at a horizontal cross foot support bar 83.

29. The apparatus of claim 28, wherein the third component includes a second pair of horizontal extending grasping bars, 110 and 111 which extend from the vertical support members 84 and 86, respectively, in opposing directions; the second pair of lower horizontal grasping bar 110 and 111 each having first sections 112 and 113, respectively, which extend in a generally horizontal direction toward the rear support members 40 and 42, respectively.

30. The apparatus of claim 29, wherein the first sections 112 and 113 are in a spaced apart and parallel relationship to the first sections 102 and 103 of the first lower grasping bars 100 and 101, respectively; each lower grasping bars 110 and 111 having a curve at an angle such that second sections 114 and 115 of the bars 110 and 111, respectively, are in a spaced apart and parallel relationship to the rear support members 42 and 44.

31. The apparatus of claim 30, wherein the second sections 114 and 115 are in a spaced apart and parallel relationship to the second sections 104 and 105 of the horizontal grasping bars 100 and 101, and the second sections 114 and 115 terminate at the horizontal cross foot support bar 83.

32. The apparatus of claim 1, wherein the fourth component of the stretching apparatus includes a pair of opposed angled grasping bars 60 and 62 which extend from a first curved horizontal grasping bar 54 to a second horizontal grasping bar 56.

33. The apparatus of claim 32, wherein the angled grasping bar 60 includes a first angled portion 63 and a vertically extending portion 65 which is operatively connected to and is generally perpendicular to the second grasping bar 56.

34. The apparatus of claim 33, wherein the opposing angled grasping bar 62 has a generally complimentary shape to the first grasping bar 60, and the second grasping bar 62 has a first angled portion section 66 and a vertically extending portion 68 which is operatively connected to and terminates at the second curved grasping bar 56.

35. The apparatus of claim 1, wherein the fifth component of the stretching apparatus includes at least one, arcuate or radially curved overhead support members 140 and 142, each overhead arcuate support member 140 and 142 having first ends 144 and 146, respectively, which extend from an upper most side bar 50*a* and terminate at second ends, 148 and 149, respectively, at an opposing upper most side bar 52*a*; and a plurality of the parallel horizontally extending overhead cross bars 150*a–i* extend from the first overhead member 140 to the second overhead member 142.

36. The apparatus of claim 1, wherein the sixth component of the stretching apparatus includes a plurality of parallel and spaced apart angled overhead grasping bars 160*a–e* which extend at an angle from a second overhead grasping member 142 to a second horizontal grasping bar 56, and a pair of opposed angled crossbars 164 and 165 which extend in opposing directions from a midportion 166 of the generally centrally located angled bar 162*c* and terminate at midportions 168 and 169 of the adjacent angled bars 162*b* and 162*d*, respectively.

37. The apparatus of claim 36, wherein at least one further angled cross bar extends between adjacent angled overhead grasping bars 160*a–e*.

38. The apparatus of claim 37, wherein each of the angled overhead bars 160*a–e* slope at a downward angle which is at about 45° from a horizontal plane defined by the second horizontal grasping bar 56.

* * * * *